US010557212B2

(12) United States Patent
Manavbasi

(10) Patent No.: US 10,557,212 B2
(45) Date of Patent: Feb. 11, 2020

(54) ELECTROPOLISHING METHOD AND PRODUCT

(71) Applicant: CHEMEON Surface Technology, LLC, Minden, NV (US)

(72) Inventor: Alp Manavbasi, Reno, NV (US)

(73) Assignee: Chemeon Surface Technology, LLC, Minden, NV (US)

( * ) Notice: Subject to any disclaimer, the term of this patent is extended or adjusted under 35 U.S.C. 154(b) by 79 days.

(21) Appl. No.: 15/453,784

(22) Filed: Mar. 8, 2017

(65) Prior Publication Data

US 2017/0260642 A1 Sep. 14, 2017

Related U.S. Application Data

(60) Provisional application No. 62/305,127, filed on Mar. 8, 2016.

(51) Int. Cl.
*C25F 3/20* (2006.01)

(52) U.S. Cl.
CPC ..... *C25F 3/20* (2013.01)

(58) Field of Classification Search
CPC ..... C25F 3/20
See application file for complete search history.

(56) References Cited

U.S. PATENT DOCUMENTS

| | | | | |
|---|---|---|---|---|
| 2,773,821 | A | 12/1956 | Smith | |
| 3,970,529 | A | 7/1976 | Martin | |
| 4,247,378 | A * | 1/1981 | Harris | C25F 3/20 205/682 |
| 5,102,508 | A | 4/1992 | Bartkowski et al. | |
| 5,616,231 | A | 4/1997 | Askin et al. | |
| 6,475,630 | B1 | 11/2002 | Uesugi et al. | |
| 6,533,917 | B1 | 3/2003 | Nishino et al. | |
| 6,579,439 | B1 | 6/2003 | Chandler | |
| 6,596,150 | B2 | 7/2003 | Nishino et al. | |
| 7,566,385 | B2 | 7/2009 | Mazur et al. | |
| 7,998,335 | B2 | 8/2011 | Feeney et al. | |
| 8,147,712 | B2 | 4/2012 | Etoh et al. | |
| 2009/0078583 | A1 * | 3/2009 | Kobata | B23H 5/08 205/641 |
| 2009/0200178 | A1 | 8/2009 | Piesslinger-Schweiger et al. | |
| 2009/0214848 | A1 | 8/2009 | Sands et al. | |
| 2013/0319878 | A1 | 12/2013 | Ida | |
| 2015/0140268 | A1 | 5/2015 | Ikawa et al. | |
| 2015/0371782 | A1 | 12/2015 | Taira et al. | |

FOREIGN PATENT DOCUMENTS

| | | | | |
|---|---|---|---|---|
| GB | 1147990 | A * | 4/1969 | C25F 3/24 |

OTHER PUBLICATIONS

Aluminum Anodizing, Jan. 21, 2008 (2 pp.).
Neufeld, P., et al., The Electropolishing of Aluminium, Electrodeposition and Surface Treatment, 3 (1975) 159-168), Jan. 22, 1975 (10 pp.).

* cited by examiner

*Primary Examiner* — Nicholas A Smith
(74) *Attorney, Agent, or Firm* — Holland & Hart, LLP

(57) ABSTRACT

A method for electropolishing a metal substrate comprises submerging at least part of the metal substrate in an electrolyte solution and applying electrical current to the metal substrate to form an electrical circuit where the metal substrate is the anode. The electrolyte solution comprises phosphoric acid and at least one acrylic monomer and/or acrylic polymer.

15 Claims, No Drawings

ELECTROPOLISHING METHOD AND PRODUCT

CROSS-REFERENCE TO RELATED PATENT APPLICATIONS

This application claims the benefit of U.S. Provisional Pat. App. No. 62/305,127, titled "Electrochemical Polishing Composition and Method for Aluminum," filed on 8 Mar. 2016, the entire contents of which are incorporated by reference into this document. In the event of a conflict, the subject matter explicitly recited or shown in this document controls over any subject matter incorporated by reference. The incorporated subject matter should not be used to limit or narrow the scope of the explicitly recited or depicted subject matter.

BACKGROUND

In chemistry and manufacturing, electrolysis is a method of using direct electrical current (DC) to drive an otherwise non-spontaneous chemical reaction. Electropolishing is an application of electrolysis for deburring metal parts and for producing a bright smooth surface finish.

The substrate or article to be electropolished is immersed in a bath of electrolyte solution and subjected to a direct electrical current. The substrate is the anode connection and one or more metal conductors surrounding the substrate in the electrolyte solution form the cathode connection.

Electropolishing relies on two opposing reactions that control the process. The first of the reactions is a dissolution reaction during which the metal from the surface of the substrate passes into solution in the form of ions. Metal is thus removed ion by ion from the surface of the substrate.

The other reaction is an oxidation reaction during which an oxide layer forms on the surface of the substrate. Buildup of the oxide film limits the progress of the ion removal reaction. This film is thickest over micro depressions and thinnest over micro projections. Because the electrical resistance is proportional to the thickness of the oxide film, the rate of metallic dissolution is fastest at the micro projections and slowest at the micro depressions. Thus, electropolishing selectively removes microscopic high points or "peaks" faster than the rate of attack on the corresponding micro depressions or "valleys."

Although conventional electropolishing has proven successful in many ways, it still has some drawbacks. For example, conventional electropolishing methods and electrolyte solutions often cannot produce substrates having a high specular finish. Also, conventional electropolishing processes for producing high gloss substrates tend to operate inefficiently at relatively high temperatures, using longer polishing times, and relatively high energy requirements.

SUMMARY

A method for electropolishing a metal substrate includes submerging the metal substrate in an electrolyte solution or bath including one or more acids, at least one acrylic monomer and/or acrylic polymer, and water. The electrolyte solution can be used to electropolish any suitable metal substrates. In a preferred embodiment, the electrolyte solution is used to electropolish metal substrates comprising aluminum.

The electrolyte solution can include any suitable acid capable of electropolishing the metal substrate. In some embodiments, the electrolyte solution includes at least one of phosphoric acid, methanesulphonic acid, and/or sulfuric acid. The electrolyte solution can include any suitable quantity of the one or more acids. In some embodiments, the electrolyte solution includes approximately 35 wt % to approximately 95 wt % of the total of the one or more acids.

In some embodiments, the electrolyte solution includes at least one hydroxyalkyl (meth)acrylate monomer and/or hydroxyalkyl (meth)acrylate polymer. In one embodiment, the electrolyte solution includes a 2-hydroxyethyl methacrylate monomer (HEMA) and/or a polymer comprising a HEMA monomer unit.

The electrolyte solution can include any suitable quantity of the at least one acrylic monomer and/or acrylic polymer. In some embodiments, the electrolyte solution includes approximately 5 g/l to approximately 200 g/l of the at least one acrylic monomer and/or acrylic polymer. In other embodiments, the electrolyte solution includes approximately 0.25 wt % to approximately 15 wt % of the at least one acrylic monomer and/or acrylic polymer.

In some applications, the electrolyte solution is used to produce high gloss aluminum surfaces. In some embodiments, the aluminum surface has a gloss measurement in the rolling direction (RD) that is at least approximately 1320. In other embodiments, the aluminum surface has a gloss measurement in the transverse direction (TD) that is at least approximately 1325. The electrolyte solution can be used to produce highly reflectively, bright surfaces from surfaces that are initially scratched, uneven, and/or mildly scored.

The electrolyte solution can be used to obtain a highly specular finish with increased efficiency at relatively low temperatures, shorter polishing times, and relatively less energy requirements, particularly for metal substrates comprising aluminum. The electrolyte solution also does not cause the formation of any known corrosive, hazardous, or toxic fumes.

In some embodiments, an electropolished metal substrate, part, or article can be made using the electropolishing method and/or electrolyte solution. For example, an electropolished aluminum substrate can be made using the electropolishing method and/or electrolyte solution.

It should be noted that the term (meth)acrylate includes acrylates and/or methacrylates. The term (meth)acrylamide includes acrylamides and/or methacrylamides. The term (meth)acrylic acid (salt) includes acrylic acids, salts of acrylic acid, methacrylic acids, and salts of methacrylic acids.

The Summary is provided to introduce a selection of select concepts in a simplified form that are further described below in the Detailed Description. There are other novel aspects and they will become apparent as this specification proceeds. Thus, the Summary and the Background are not intended to identify key concepts or essential aspects of the disclosed subject matter, nor should they be used to constrict or limit the scope of the claims. For example, the scope of the claims should not be limited based on whether the recited subject matter includes any or all aspects noted in the Summary and/or addresses any of the issues noted in the Background.

DETAILED DESCRIPTION

A method for electropolishing (also referred to as electrochemical polishing) a metal substrate includes submerging at least a portion of the metal substrate in an electrolyte solution or bath (also referred to as an electrolyte composition, electrochemical polishing solution, electropolishing solution) including one or more acids, at least one acrylic monomer and/or acrylic polymer, and water.

The electrolyte solution can be used to polish any suitable metal substrate. In some embodiments, the electrolyte solution is used to polish metal substrates comprising any of the following metals and/or their alloys: aluminum, brass, carbon steel, copper, nickel, specialty alloys, stainless steel, titanium, and the like. The metal substrate can include these metals and their alloys in any combination and/or configuration—e.g., layers of different metals and/or metal alloys.

The electrolyte solution is especially suitable for use with aluminum substrates. It produces highly reflectively and bright aluminum surfaces even when the surfaces are initially scratched, uneven, and/or mildly scored. Examples of suitable aluminum substrates include any substrate that comprises commercially pure aluminum and/or one or more aluminum alloys.

The electrolyte solution includes phosphoric acid, at least one acrylic monomer and/or acrylic polymer, and water. The electrolyte solution can also include one or more additional acids and/or other organic additives.

The electrolyte solution can include any suitable amount of phosphoric acid required to effectively electropolish the metal substrate. In some embodiments, the electrolyte solution comprises approximately 45 wt % to approximately 90 wt % phosphoric acid or, preferably, approximately 55 wt % to approximately 85 wt % phosphoric acid. In other embodiments, the electrolyte solution comprises at least approximately 45 wt % phosphoric acid or at least approximately 55 wt % phosphoric acid. In other embodiments, the electrolyte solution comprises no more than 90 wt % phosphoric acid or no more than 85 wt % phosphoric acid.

The electrolyte solution can include any suitable acrylic monomer and/or acrylic polymer. The acrylic polymer can include any polymer comprising an acrylic monomer unit. Suitable acrylic monomers include those from the following groups: (meth)acrylates, (meth)acrylic acids (salt), (meth) acrylamides, acrylonitriles, bisphenol acrylics, carbohydrate monomers, fluorinated acrylics, maleimides, and polyfunctional acrylics.

In some embodiments, the electrolyte solution comprises at least one (meth)acrylate monomer and/or (meth)acrylate polymer. The (meth)acrylate polymer can include any polymer comprising a (meth)acrylate monomer unit. Examples of suitable (meth)acrylate monomers include alkyl (meth) acrylates, aryl (meth) acrylates, and hydroxyalkyl (meth) acrylates.

In some embodiments, the electrolyte solution comprises at least one alkyl (meth)acrylate monomer, aryl (meth) acrylate monomer, hydroxyalkyl (meth)acrylate monomer, alkyl (meth)acrylate polymer, aryl (meth)acrylate polymer, and/or hydroxyalkyl (meth)acrylate polymer. The polymers can include any polymer comprising a corresponding monomer unit—e.g., a (meth)acrylate polymer can any polymer comprising one or more (meth)acrylate monomer units.

Examples of suitable alkyl (meth)acrylate monomers include methyl acrylate, ethyl acrylate, butyl acrylate, isobutyl acrylate, tert-butyl acrylate, hexyl acrylate, 2-ethylhexyl acrylate, octyl acrylate, isooctyl acrylate, decyl acrylate, isodecyl acrylate, lauryl acrylate, tridecyl acrylate, octadecyl acrylate, behenyl acrylate, methyl methacrylate, ethyl methacrylate, and the like.

Examples of suitable aryl (meth)acrylate monomers include 2-naphthyl acrylate, is obornyl acrylate, tetrahydrofurfuryl acrylate, 2-tetrahydropyranyl acrylate, 4-tert-butylcyclohexyl acrylate, dicyclopentenyl acrylate, 4-acetoxyphenethyl acrylate, 9-anthracenylmethyl acrylate, fluorescein o-acrylate, ethylene glycol phenyl ether acrylate, 2-hdyroxy-3-phenoxypropyl acrylate, benzyl 2-ethyl acrylate, ethylene glycol dicyclopentenyl ether acrylate, pentabromobenzyl acrylate, pentafluorophenyl acrylate, and the like. Examples of suitable hydroxyalkyl (meth)acrylate monomers include 2-hydroxyethyl acrylate, hydroxypropyl acrylate, 4-hydroxybutyl acrylate, 2-hydroxyethyl methacrylate (HEMA), and the like.

Examples of other suitable (meth)acrylate monomers include vinyl acrylate, 10-undecenyl acrylate, ethylene glycol methyl ether acrylate, di(ethylene glycol) ethyl ether acrylate, 2-carboxyethyl acrylate, propargyl acrylate, urethane acrylate methacrylate, epoxidized acrylate, dipentaerylthritol penta-/hexa acrylate, 11-phosphonoundecyl acrylate, 2-(dimethylamino)ethyl acrylate, 2-chloroethyl acrylate, methyl 2-(chloromethyl) acrylate, trimethylsilyl acrylate, ethyl 2-(trimethylsilylmethyl) acrylate, 3-(trimethoxysilyl) propyl acrylate, and the like.

In a preferred embodiment, the electrolyte solution includes at least one hydroxyalkyl (meth)acrylate monomer and/or hydroxyalkyl (meth)acrylate polymer. The hydroxyalkyl (meth)acrylate polymer can include any polymer comprising a hydroxyalkyl (meth)acrylate monomer unit. In one embodiment, the electrolyte solution includes a 2-hydroxyethyl methacrylate monomer and/or a polymer that comprises at least one 2-hydroxyethyl methacrylate monomer unit.

In some embodiments, the electrolyte solution comprises at least one (meth)acrylic acid (salt) monomer and/or (meth) acrylic acid (salt) polymer. The (meth)acrylic acid (salt) polymer can include any polymer comprising a (meth) acrylic acid (salt) monomer unit. Examples of suitable (meth)acrylic acid (salt) monomers include sodium acrylate, sodium methacrylate, 3-sulfopropyl acrylate potassium salt, metal acrylates such as zinc acrylate and zirconium acrylate, zirconim carboxyethyl acrylate, hafnium carboxyethyl acrylate, and the like.

In some embodiments, the electrolyte solution comprises at least one (meth)acrylamide monomer and/or (meth)acrylamide polymer. The (meth)acrylamide polymer can include any polymer comprising a (meth)acrylamide monomer unit. In some embodiments, the electrolyte solution comprises at least one acrylonitrile monomer and/or acrylonitrile polymer. The acrylonitrile polymer can include any polymer comprising an acrylonitrile monomer unit.

In some embodiments, the electrolyte solution comprises at least one bisphenol acrylic monomer and/or bisphenol acrylic polymer. The bisphenol acrylic polymer can include any polymer comprising a bisphenol acrylic monomer unit. In some embodiments, the electrolyte solution comprises at least one carbohydrate monomer and/or carbohydrate polymer. The carbohydrate polymer can include any polymer comprising a carbohydrate monomer unit.

In some embodiments, the electrolyte solution comprises at least one fluorinated acrylic monomer and/or fluorinated acrylic polymer. The fluorinated acrylic polymer can include any polymer comprising a fluorinated acrylic monomer unit. Examples of suitable fluorinated acrylic monomers include 2,2,2-trifluoroethyl acrylate, 1,1,1,3,3,3-hexafluoroisopropyl acrylate, methyl 2-(trifluoromethyl) acrylate, 2,2,3,3,3-pentafluoropropyl acrylate, pentafluorophenyl acrylate, 2,2,3,3,4,4,4-heptafluorobutyl (meth)acrylate, 3,3,4,4,5,5,6,6,7,7,8,8,8-tridecafluorooctyl acrylate, 2,2,3,3,4,4,5,5-octafluoropentyl acrylate, and the like.

In some embodiments, the electrolyte solution comprises at least one maleimide monomer and/or maleimide polymer. The maleimide polymer can include any polymer comprising a maleimide monomer unit. In some embodiments, the electrolyte solution comprises at least one polyfunctional acrylic monomer and/or polyfunctional acrylic polymer. The polyfunctional acrylic polymer can include any polymer comprising a polyfunctional acrylic monomer unit.

In some embodiments, the electrolyte solution comprises one or more acrylic polymers including poly(L-lactide) with or without being acrylate terminated, poly(ethylene glycol) methyl ether acrylate, poly(propylene glycol) acrylate, poly (methyl methacrylate-co-ethyl acrylate), poly(ethylene-co-ethyl acrylate), poly(2-ethylhexyl acrylate), poly(butyl acrylate), poly(methyl acrylate), poly(pentabromophenyl acrylate), poly (tetrafluoropropyl acrylate), poly(2-naphthyl acrylate), poly(propylene glycol) methyl ether acrylate, and the like.

The electrolyte solution can include any suitable amount of the at least one acrylic monomer and/or acrylic polymer. In some embodiments, the electrolyte solution comprises approximately 5 g/l to approximately 200 g/l of the at least one acrylic monomer and/or acrylic polymer or approximately 15 g/l to approximately 120 g/l of the at least one acrylic monomer and/or acrylic polymer. In other embodiments, the electrolyte solution comprises approximately 0.25 wt % to approximately 15 wt % of the at least one acrylic monomer and/or acrylic polymer or approximately 0.5 wt % to approximately 9 wt % of the at least one acrylic monomer and/or acrylic polymer.

The electrolyte solution can include one or more additional acids (acids other than phosphoric acid). Suitable acids include methanesulfonic acid, sulfuric acid, and the like. The electrolyte solution can include any suitable amount of additional acid. In some embodiments, the electrolyte solution includes approximately 0 to approximately 600 g/l of additional acid or approximately 5 g/l to approximately 400 g/l of additional acid. In other embodiments, the electrolyte solution includes approximately 0 to approximately 30 wt % of additional acid or approximately 1 wt % to approximately 20 wt % additional acid.

In some embodiments, the electrolyte solution includes approximately 0 g/l to approximately 100 g/l of methanesulfonic acid or approximately 1 g/l to approximately 50 g/l of methanesulfonic acid. In some embodiments, the electrolyte solution includes approximately 0 wt % to approximately 7.5 wt % methanesulfonic acid or approximately 0.5 wt % to 5 wt % methansulfonic acid.

In some embodiments, the electrolyte solution includes approximately 0 g/l to approximately 600 g/l of sulfuric acid or approximately 5 g/l to approximately 400 g/l of sulfuric acid. In some embodiments, the electrolyte solution includes approximately 0 wt % to approximately 30 wt % sulfuric acid or approximately 1 wt % to approximately 20 wt % sulfuric acid.

The electrolyte solution can include any suitable total amount of acid (phosphoric acid plus any additional acids). In some embodiments, the electrolyte solution includes approximately 35 wt % to approximately 95 wt % total acid or approximately 40 wt % to approximately 90 wt % total acid.

The electrolyte solution can also exclude certain acids. For example, in some embodiments, the electrolyte solution can be free of or only include trace amounts of strong acids such as hydrochloric acid and/or nitric acid.

The electrolyte solution can be used to produce high gloss aluminum surfaces. In some embodiments, the aluminum surface has a gloss measurement in the rolling direction (RD) or the transverse direction (TD) that is at least approximately 1320, at least approximately 1350, at least approximately 1375, at least approximately 1400, or at least approximately 1425.

The electrolyte solution also includes water. The amount of water can vary widely depending on the siutation. In some embodiments, the electrolyte solution includes approximately 5 wt % to approximately 60 wt % water.

Any suitable process can be used to electropolish the metal substrate using the electrolyte solution. A typical process can include one or more of the following steps: (1) surface preparation, (2) cleaning, (3) electropolishing, (4) first rinse, (5) acid rinse, and/or (6) final rinse. Each of these steps is described in greater detail below.

Surface preparation and morphology can influence the electropolishing results. Metal substrates or articles having a fine grain free of metallic seams, inclusions, and directional roll marks produce the best electropolishing results. In some embodiments, the metal substrate can be pre-polished prior to electropolishing to provide a brighter more chrome-like finish.

In some situations, the metal substrate may be pre-treated to reduce surface blemishes, imperfections, nicks, scratches, and the like. This is especially true for surface imperfections that are larger or deeper than the amount of material removed by electropolishing. The pre-treatment, although not required, may be used to increase the likelihood of producing smooth, bright, high gloss surfaces. Pre-treatment may be especially suitable for metal substrates having surfaces that are porous as a result of mill finish, pickling, or have an "orange peel" appearance.

Examples of suitable pre-treatment methods include wheel polishing, tumbling, belt sanding, shot-peening, or blasting. Acid or alkaline etching can also be used to eliminate surface blemishes and imperfections but may reduce the possibility of achieving bright, high gloss, true mirror finishes. These treatments, used in conjunction with electropolishing, may also be used to produce very appealing and unusual finishes.

In some embodiments, the metal substrate is cleaned before being placed in the electrolyte solution. Cleaning the metal substrate produces the most uniform electropolishing results. Grease, oil, or soil, if not removed, forms a film or scum on the surface of the electropolishing solution that can adhere to the parts as they enter and exit the bath. Examples of suitable cleaning processes include vapor degreasing, solvent cleaning, soak-tank, and/or electrolytic cleaning. Care should be taken to thoroughly rinse the metal substrate when strong uninhibited caustic-type cleaners are used because they can attack and etch aluminum, as well as neutralize the acidity of the electropolishing bath.

Once the metal substrate is sufficiently prepared, it is ready to be electropolished. The finish on the metal substrate can be adjusted from satin to mirror-bright by controlling variables such as immersion time, bath temperature, currently density, and the like. In general, a low temperature and/or short immersion time produce finishes in the satin range and higher temperature and/or longer immersion time produce finishes that are brighter and more mirror-like. Higher temperatures and current densities decrease the immersion time necessary to product bright finishes, as well as deburring and stock removal for size control.

Prior to electropolishing, the metal substrate should be rinsed in water to eliminate any residual cleaner, unless solvent cleaning or vapor degreasing was used. The metal substrate is at least partially submerged or immersed in the electrolyte solution. The metal substrate is electrically coupled to the positive terminal of a direct current power supply thereby making the metal substrate the anode in the resulting electrical circuit. The negative terminal is electrically coupled to another material that is the cathode.

The power supply is used to apply an electrical current to the metal substrate. The power supply can operate at any suitable voltage such as approximately 6 volts to approximately 48 volts or approximately 12 volts to 24 volts. The current density can also be any suitable amount. In some embodiments, the current density ranges from approximately 40 amps/$ft^2$ to approximately 80 amps/$ft^2$ (4.3 A/$dm^2$ to 8.16 A/$dm^2$). There is generally an inverse relationship between electropolishing time and voltage. For example, increasing the voltage can reduce the electropolishing time and vice versa. Voltage can also be increased when the distance between the anode and cathode is relatively large.

The electrolyte solution can be at any suitable temperature that facilitates electropolishing of the metal substrate. In some embodiments, the electrolyte solution is heated. For example, the electrolyte solution can be maintained at a temperature of approximately 30° C. to approximately 90° C., approximately 37° C. to approximately 80° C., or, preferably, approximately 45° C. to approximately 60° C.). High temperatures allow higher current densities, which produce a brighter finish in less time.

The electropolishing process can use any suitable cathode. In some embodiments, straight lead tank cathodes, especially for standard shaped parts or when polishing is not required on internal surfaces. In other embodiments, conforming shaped cathodes are used, especially for irregular or shaped parts or when polishing is required on internal surfaces. When conforming shaped cathodes are used they are usually constructed of chemical sheet lead, similar in practice as chromium plating.

The metal substrate can be positioned in a rack in the electrolyte solution. The rack can be constructed of any suitable material such as aluminum or titanium. The current density for electropolishing is relatively high (especially compared to anodizing), therefore, sufficient cross sectional area for the rack should be provided. Copper or other alloys may also be used, but copper contamination of the solution may cause an immersion deposit on aluminum during transfer, unless coated. The metal substrates can be positioned in the rack, hung on hooks, clamped or held by fingers to insure good electrical contact.

The metal substrate is positioned in the electrolyte solution in such a manner as to allow the greatest area to be exposed parallel to the cathodes. Parts also should be oriented to prevent gas pockets. Exposed portions of racks and tips (except titanium) are subject to electrochemical attack and gradually diminish in thickness. Dipping the tips in molten solder periodically to build up size may increase the useful life of the rack. Other exposed parts of the rack not contacting the part to be polished should be insulated with rack coating or masking materials such as used on plating racks.

In some embodiments, the process includes agitating the electrolyte solution. Agitation can be provided by solution agitation, air agitation, or work-rod agitation with the latter method being preferred. If solution or air agitation are employed, then it should be conducted in a way that produces complete and uniform agitation, preferably without disturbing the sludge build-up in the bottom of the tank. Good agitation can eliminate gas streaks, pockets and burning and allow higher current densities to be used, thus decreasing the time required to electropolish to the desired finish. When agitation is used the parts are racked securely.

A decrease in current density may be noticed shortly after current is applied during electropolishing. This can be due to polarization and film formation and can be reduced by proper agitation. While most of the emphasis is given to the anode reactions the cathode reactions should not be neglected. Basic metal salts are precipitated on the cathode by hydrogen reduction to restrain the increase of metal content in the electrolyte. The ratio of the cathode area to the anode area should be at least 2 to 1 and preferably 3 or 4 to 1. The basic salts precipitated on the cathodes should be removed regularly. To reduce resistance and maintain a uniform current flow the cathode can be soaked in water several hours or overnight and brushed clean before returning to the tank.

The metal substrate is removed from the electrolyte solution and rinsed by immersion or spray to remove any residual electrolyte solution. The rinse water can be any suitable temperature. Ordinarily ambient temperature water is preferred compared to cold water, because the solution will rinse faster. Depending on the operating temperature of the electrolyte solution, transfer of the metal substrates to the water rinse should be prompt to prevent chemical attack on the metal surface while in the air.

The metal substrate is then rinsed with an acid. This stage is especially useful in preventing a milky or cloudy film from appearing on the finished piece, as well as eliminating the dark smut which may possibly appear due to the presence of copper in the alloy or the solution. The acid and water solution can include any suitable acid. In some embodiments, it is made from 20% to 35% nitric acid (by volume) with the balance being water. It can be used at ambient temperature. The metal substrate is rinsed with water. This rinse is usually operated hot, to dry the metal substrate rapidly and rinse off any remaining traces of acid from the acid rinse.

It should be appreciated that several compounds may be added to enhance the appearance, eliminate water spotting, and speed the drying of the finished piece. Examples of such compounds include wetting agents, sequestering agents, and chelating agents.

The process can be performed using a variety of suitable equipment. For example the power supply or power source can be supplied either by rectifiers or low voltage motor generator sets—the same type of equipment used for electroplating. The cathode can be any suitable material such as chemical lead, 300 series stainless steel, or the like.

The electrolyte solution can be heated using any suitable heat source and/or equipment. For example, heat can be supplied by steam passing through lead coils, carbate, tantalum or type 316 stainless steel pipe or plate type coils. Also, heat can be supplied by electric heaters such as electric immersion heaters, quartz, Carpenter "20" or Hastelloy "C."

The electrolyte solution can be positioned in any suitable tank. For example, the tank can be constructed of lead-lined PVC or Koroseal lined steel tanks. Also, the tank can be made of polyethylene, polypropylene, fiberglass linings, or type 316 stainless steel. Tanks made of the same materials can be used for the various rinsing steps as well.

EXAMPLES

The following examples illustrate preferred embodiments of electrochemical polishing compositions and methods for using them. The examples should not be used to constrict or limit the scope of the claims in any way.

The following procedure was used in both of the examples. All samples were mechanically buffed, cleaned in a mild alkaline cleaner (Chemeon Cleaner 1000—a non-etch low alkalinity (pH 9) powdered cleaner) for 2 min at 50° C., rinsed in deionized water, optionally treated with a deoxidizer (Chemeon Deox 3300—a non-iron, granular oxidizer that is added to sulfuric acid and/or nitric acid to produce an effective deoxidizer for all wrought alloys and some castings) for 30 seconds, and rinsed. The cleaned samples were submersed in electrochemical polishing solution maintained at 55° C. for 120 seconds, then different current densities and voltage were applied. A DC rectifier was used to adjust the voltage and current.

Example 1

An electrochemical polishing solution was prepared containing 75 wt % $H_3PO_4$ (1.84 s.g.), 30 g/12-hydroxyethyl methacrylate (HEMA), 10 wt % $H_2SO_4$, the rest being water. Buffed 6061-T6 aluminum alloys were cleaned then treated in the electrochemical polishing solution. The treatment was carried out at 60 ASF (amperes/square foot) and 20V and the solution temperature was 55° C. for 120 seconds. Immediately after electrochemical polishing, test coupons were rinsed in deionized water for 60 seconds and then treated in Chemeon Deoxidizer 3300 for 45 seconds at 21° C. After the deoxidizer treatment, the samples were rinsed and forced air dried. Gloss measurements were taken along the rolling direction (RD) and transverse direction (TD) at 20°. The gloss measurements are as follows.

Before electrochemical polishing (buffed):
TD: 1147.5±64.7
RD: 1220.3±65.8

After electrochemical polishing:
TD: 1425.4±61.9
RD: 1452.0±91.4

Example 2

An elelctrochemical polishing solution was prepared containing 70 wt % $H_3PO_4$ (1.84 s.g.), 60 g/l 2-hydroxyethyl methacrylate (HEMA), 30 g/l methanesulfonic acid, 10 wt % $H_2SO_4$, the rest being water. Buffed 6061-T6 aluminum alloys were cleaned then treated in the electrochemical polishing solution. The treatment was carried out at 60 ASF (amperes/square foot) and 20V and the solution temperature was 55° C. for 120 seconds. Immediately after electrochemical polishing, test coupons were rinsed in deionized water for 60 seconds and then treated in Chemeon Deoxidizer 3300 for 45 seconds at 21° C. After the deoxidizer treatment, the samples were rinsed and forced air dried. Gloss measurements were taken along the rolling direction (RD) and transverse direction (TD) at 20°.

Before electrochemical polishing (buffed):
TD: 1248.3±66.9
RD: 1278.3±35.7

After electrochemical polishing:
TD: 1466±42.4
RD: 1471.0±32.7

The examples show that aluminum or aluminum alloys can be used to produce articles having a highly reflective and bright surface even though the surface before electrochemical polishing treatment is scratched, uneven and/or mildly scored.

Illustrative Embodiments

Reference is made in the following to several illustrative embodiments of the disclosed subject matter. The following embodiments illustrate only a few selected embodiments that may include one or more of the various features, characteristics, and advantages of the disclosed subject matter. Accordingly, the following embodiments should not be considered as being comprehensive of all the possible embodiments.

In one embodiment, a method for electropolishing a metal substrate comprises submerging at least part of the metal substrate in an electrolyte solution comprising phosphoric acid and at least one acrylic monomer and/or acrylic polymer and applying electrical current to the metal substrate to form an electrical circuit, wherein the metal substrate is an anode in the electrical circuit. The metal substrate can comprise stainless steel, aluminum, and/or titanium. The electrolyte solution can comprise at least one (meth)acrylate monomer and/or (meth)acrylate polymer.

In another embodiment, a method for electropolishing an aluminum substrate comprises submerging at least part of the aluminum substrate in an electrolyte solution comprising phosphoric acid and at least one acrylic monomer and/or acrylic polymer and applying electrical current to the aluminum substrate to form an electrical circuit, wherein the aluminum substrate is an anode in the electrical circuit. The aluminum substrate can comprise commercially pure aluminum and/or an aluminum alloy.

The electrolyte solution can comprise approximately 45 wt % to approximately 90 wt % phosphoric acid or approximately 55 wt % to approximately 85 wt % phosphoric acid. The electrolyte solution can comprise at least one (meth) acrylate monomer and/or (meth)acrylate polymer. The electrolyte solution can comprise at least one hydroxyalkyl (meth)acrylate monomer and/or hydroxyalkyl (meth)acrylate polymer.

The electrolyte solution can comprise approximately 5 g/l to approximately 200 g/l of the at least one acrylic monomer and/or acrylic polymer. The electrolyte solution can comprise at least one additional acid. The electrolyte solution can comprise at least one of methansulfonic acid and/or sulfuric acid. The electrolyte solution can comprise water. The electrolyte solution may not include hydrochloric acid.

The method can comprise agitating the electrolyte solution while the aluminum substrate is positioned in the electrolyte solution. After electropolishing, the aluminum substrate can have a gloss measurement in either the rolling direction or the transverse direction that is at least approximately 1320 or at least approximately 1400. The electropolishing method can be performed at atmospheric pressure. The method can comprise electropolishing the aluminum substrate in an open enclosure.

Additional Considerations

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

The invention claimed is:

1. A method for electropolishing an aluminum substrate comprising:

submerging at least part of the aluminum substrate in an electrolyte solution comprising:

phosphoric acid;

at least one hydroxyalkyl (meth)acrylate monomer and/or hydroxyalkyl (meth)acrylate polymer;

supplying electrical current to the aluminum substrate from a power supply;

wherein the aluminum substrate is electrically coupled to a positive terminal of the power supply.

2. The method of claim 1 wherein the aluminum substrate comprises commercially pure aluminum.

3. The method of claim 1 wherein the aluminum substrate comprises an aluminum alloy.

4. The method of claim 1 wherein the electrolyte solution comprises approximately 45 wt % to approximately 90 wt % phosphoric acid.

5. The method of claim 1 wherein the electrolyte solution comprises approximately 55 wt % to approximately 85 wt % phosphoric acid.

6. The method of claim 1 wherein the electrolyte solution comprises approximately 5 g/l to approximately 200 g/l of the at least one hydroxyalkyl (meth)acrylate monomer and/or hydroxyalkyl (meth)acrylate polymer.

7. The method of claim 1 wherein the electrolyte solution comprises at least one additional acid.

8. The method of claim 1 wherein the electrolyte solution comprises at least one of methanesulfonic acid and/or sulfuric acid.

9. The method of claim 1 wherein the electrolyte solution comprises water.

10. The method of claim 1 comprising agitating the electrolyte solution while the aluminum substrate is positioned in the electrolyte solution.

11. The method of claim 1 wherein the aluminum substrate has a gloss measurement in either the rolling direction or the transverse direction that is at least approximately 1320.

12. The method of claim 1 wherein the aluminum substrate has a gloss measurement in either the rolling direction or the transverse direction that is at least approximately 1400.

13. The method of claim 1 wherein the method for electropolishing the aluminum substrate is performed at atmospheric pressure.

14. The method of claim 1 comprising electropolishing the aluminum substrate in an open enclosure.

15. The method of claim 1 wherein the electrolyte solution does not include hydrochloric acid.

* * * * *